US012077248B2

(12) United States Patent
Posner

(10) Patent No.: US 12,077,248 B2
(45) Date of Patent: Sep. 3, 2024

(54) MOORING WHIP BASE

(71) Applicant: Docking Products LLC, Nokomis, FL (US)

(72) Inventor: Samuel L Posner, North Miami Beach, FL (US)

(73) Assignee: Docking Products LLC, Nokomis, FL (US)

( * ) Notice: Subject to any disclaimer, the term of this patent is extended or adjusted under 35 U.S.C. 154(b) by 418 days.

(21) Appl. No.: 17/486,282

(22) Filed: Sep. 27, 2021

(65) Prior Publication Data

US 2022/0106018 A1 Apr. 7, 2022

Related U.S. Application Data

(60) Provisional application No. 63/204,435, filed on Oct. 5, 2020.

(51) Int. Cl.
*E02B 3/24* (2006.01)
*B63B 21/00* (2006.01)
*B63B 21/04* (2006.01)

(52) U.S. Cl.
CPC ..... *B63B 21/00* (2013.01); *B63B 21/04* (2013.01); *E02B 3/24* (2013.01); *B63B 2021/001* (2013.01)

(58) Field of Classification Search
CPC ..... E02B 3/24; B63B 21/00; B63B 21/04; B63B 21/08; B63B 2021/001; B63B 2021/003
USPC ..... 114/230.11
See application file for complete search history.

(56) References Cited

U.S. PATENT DOCUMENTS 3,157,150 A * 11/1964 Faber, Jr. ..... E02B 3/24 114/230.18
4,040,377 A * 8/1977 Olsen ..... B63B 21/00 114/230.11
4,280,440 A * 7/1981 Barton ..... E02B 3/24 114/230.11
D306,396 S * 3/1990 Brushaber ..... D8/355
5,154,132 A * 10/1992 Brushaber ..... E02B 3/24 114/230.11
5,243,926 A * 9/1993 Wright ..... B63B 21/00 114/230.19
5,425,324 A * 6/1995 Cotton ..... B63B 21/00 114/230.1
5,513,592 A * 5/1996 Cotton ..... B63B 21/00 405/219
6,578,509 B1 * 6/2003 Brushaber ..... B63B 21/04 114/230.11
6,662,740 B1 * 12/2003 Noe ..... E02B 3/24 114/230.11
7,555,993 B2 * 7/2009 Quinn ..... B63B 21/04 114/230.11

(Continued)

*Primary Examiner* — Frederick L Lagman
(74) *Attorney, Agent, or Firm* — R. Neil Sudol; Henry D. Coleman

(57) ABSTRACT

An improved pole support base mounted to a dock has means to pivot a housing supporting an inserted flexible pole and means to lock the pivoted pole in a vertical position to clear the pole from interfering with a vessel leaving from or returning to the dock. The pivotable housing and pole are manually lowered down to a determined desired degree to position the flexible pole and a line or rope that passes around a pulley at the end of the pole and is attached to a boat cleat to prevent possible damage owing to the vessel contacting the dock.

20 Claims, 4 Drawing Sheets

(56) References Cited

U.S. PATENT DOCUMENTS

| | | | | |
|---|---|---|---|---|
| 7,789,033 | B2 * | 9/2010 | Doig | B63B 21/00 114/230.17 |
| 9,205,893 | B2 * | 12/2015 | Posner | B63B 21/00 |
| 2011/0023766 | A1 * | 2/2011 | Disanza | B63B 21/00 114/230.11 |
| 2014/0182503 | A1 * | 7/2014 | Posner | B63B 21/00 114/230.11 |

* cited by examiner

MOORING WHIP BASE

BACKGROUND OF THE INVENTION

This invention relates to a mooring whip base.

A mooring whip base is a pole holder that is securely fastened to a boat dock and that receives a lower end of a cylindrical mooring pole that supports a mooring cord or rope. The pole and the rope are collectively termed "mooring whip." The rope passes over a pulley at the free end of the pole and is coupled to a boat or other water craft for securing the craft to a dock. Mooring poles are generally made of fiberglass and extend out beyond the boat which is positioned parallel to the dock. Mooring poles offer resistance by flexing, the mooring whips serving to maintain a boat at a safe distance from a dock so as to prevent the boat from colliding with the dock due to common occurrences such as tidal changes, wakes from passing boats, or wind gusts. Generally, at least two mooring whips are deployed for a boat, one at the bow and one at the stern. This invention focuses on the bases or pole holders.

PRIOR ART

It has been common to provide mooring whip bases mounted to portions of a boat dock, no existing mooring whip base has effectively addressed the problem of poles protruding out over a boat and water in an effective angled position which does not interfere with parts of the boat and dock structures such as deck equipment, rigging lines, permanent fishing equipment, and other obstructions, making it difficult if not impossible to leave and return to the dock without coming in contact with the poles and hanging lines. U.S. Pat. No. 4,040,377 to Olsen attempts to obviate the interference of whip poles with a moored boat by providing a small compressed rubber insert that purportedly has the resilience to force the return to a vertical position a solid fiberglass pole in the range of fourteen feet in length and with extreme cantilever loads that put extreme stress on the three bolt arrangement of Olsen's support base. In reality the resilient insert is effective for only a short period of time owing to weather exposure and material memory causing a failure in effective function. U.S. Design Pat. No. D306,396 to Brushaber discloses an adjustable mooring whip base that may be vertically positioned but only with the use of tools. This mooring whip device is not practical when one is leaving or arriving at a dock and it is not designed to be mounted on the side of a piling only the face of which protrudes out towards the boat, presenting an obstacle which may cause serious damage.

OBJECTS OF THE INVENTION

It is an object of the present invention to provide an improved mooring whip base assembly.

Another object of the present invention is to provide such a mooring whip base that is easy to use.

A further object of the present invention is to provide such a mooring whip base that has greater reliability and longevity than existing designs.

These and other objects of the present invention will be apparent from the drawings and descriptions hereof. Although every object of the invention is considered to be attained by at least one embodiment of the invention, there is not necessarily any single embodiment that achieves all of the objects of the invention.

SUMMARY OF THE INVENTION

The present invention is directed to a mooring whip base for holding a flexible pole provided at a free end, opposite the base, with a pulley about which a mooring line or rope turns to extend downwardly to a boat or other water craft disposed beside the mooring whip base on a dock. The pole and line are collectively dubbed a "mooring whip" as the line extends whip-like from the end of the pole and whips about as the boat dances in tune to prevailing wind and water currents. The mooring whip and base assembly serves to maintain boats and other water craft at a safe distance from the dock so as to prevent damage to the boat owing to collisions with the dock owing to tidal changes, wakes from passing boats, wind gusts, etc.

Typically two pole holders or bases are mounted to a dock at positions spaced from one another by a distance comparable to the length of the craft to be moored. Respective flexible poles extend from the bases out beyond and above the craft, which is positioned generally parallel to the dock. These bases are preferably located so that one respective line or rope may be tethered to a bow cleat while the other is fastened to a cleat at the stern of the boat. The lines or ropes extend around the pulleys fixed to the outer ends of the respective mooring poles and are secured (wound) to a cleat on the mooring whip base. The boat's nominal distance from the dock is governed by a fixed dock line extending from the boat and secured to the dock, which is not subject of this invention. The mooring whip lines, each attached at one end to boat cleats pass over pulleys at the free or upper ends of respective mooring poles. As these lines tighten and the poles flex as the boat glides away from the dock, restoring forces that increase in magnitude serve to return the boat towards the dock.

A mooring whip base in accordance with the present invention comprises a hollow support housing, a hollow swivel housing, a shaft, a polygonal frame, and a locking plate or tab extension. The support housing is attachable to a dock, while the swivel housing has a lower portion movably disposed in the support housing, a lower end of a mooring pole being insertable into the swivel housing. The swivel housing has two opposed walls provided each provided with an opening, a shaft fixed to the support housing traversing the openings. The polygonal frame surrounds the hollow swivel housing and is slidably mounted thereto. The locking plate or tab extends from the polygonal frame in a plane perpendicular to a longitudinal axis of the swivel housing. The locking plate is insertable into the hollow support housing at an upper end thereof for releasably preventing, or at least limiting, a pivoting of the swivel housing upon a disposition thereof in a vertical or upright orientation relative to the support housing.

According to another feature of the present invention, the support housing and the swivel housing each have the form of a right rectangular prismatic tubular member having a rectangular perimeter or wall. The sliding polygonal frame is concomitantly rectangular, with the locking plate being attached to a lower side of the polygonal frame. The polygonal frame rests on an upper edge of the support housing upon a disposition of the swivel housing in the vertical or upright orientation relative to the hollow support housing.

According to a further feature of the present invention, the mooring whip base further comprises a mounting member, the support housing being fixed to the mounting member, which in turn is connectable at least indirectly to the dock.

The support housing, the hollow swivel housing, the polygonal frame, and the locking plate are all preferably made of a hard and substantially rigid polymeric material.

The shaft connecting the swivel housing to the support is preferably cylindrical and has an outer diameter. The openings in the swivel housing that receive the shaft are larger than the outer diameter of the shaft, thereby providing play in the movement of the swivel housing relative to the support. The play enable some translation of the swivel housing (and a mooring pole inserted therein) in a direction towards and away from a moored craft, whereby pivoting of the swivel housing within desired limits is unimpeded by the proximity of the swivel housing to the support housing.

A mooring whip base in accordance with the present invention broadly comprises a support, a swivel member, a shaft, and a locking member. The support is attachable to a dock. The swivel member is at least pivotably mounted to the support. In a preferred embodiment, the swivel member may translate to a limited extent to enable the pivoting movement. A lower end of a mooring pole is releasably couplable to the swivel member, for instance, by being inserted into the swivel member. The shaft attaches the swivel member to the support and is configured with the swivel member and the support so that the swivel member is pivotable relative to the support. The locking member slidably connects to the swivel member for movement along the swivel member. The locking member includes an extension, tongue or tab projecting in a plane perpendicular to a longitudinal axis of the swivel member. The extension is releasably couplable to the swivel member for temporarily constraining the pivoting of the swivel member upon a disposition thereof in a vertical or upright orientation relative to the support.

Preferably, the support and the swivel member each take the form of a tubular member, with a lower end of the swivel member being inserted into the support. More preferably, the support and the swivel member each take the form of a right rectangular prismatic tubular member—that is, a box-like configuration.

Pursuant to a more specific feature of the present invention, the shaft defines a pivot axis of the swivel member, and the shaft is rigidly fixed to the support. The shaft traverses a pair of openings in the swivel member, which are preferably larger than an outer dimension of the shaft, to enable pivoting of the swivel member where that member is inserted into the support and thus restricted in motion by the surrounding support.

Pursuant to another feature of the present invention, the locking member surrounds the swivel member and is slidable along the swivel member parallel to an axis thereof, the extension or tongue or tab being attached to a lower side of the locking member. The locking member rests on an upper edge of the support and the extension is located inside an upper end of the support upon a disposition of the swivel member in the vertical or upright orientation relative to the support.

A mounting member such as a horizontal plate or a C-channel may be affixed to the support, the horizontal plate being connectable to a floor surface of the dock and the C-channel being attachable along a vertical surface of a piling. Again, the support, the swivel member, the locking member, and the extension are all preferably made of a substantially rigid polymeric material.

A method for mooring a water craft to a dock comprises, in accordance with the present invention, (a) providing a whip base including a support attached to the dock, (b) inserting a lower end of a mooring pole into a swivel member pivotably attached to the support, (c) pivoting the swivel member relative to the support so that the mooring pole extends at an acute angle from the dock towards a watercraft, (d) extending a mooring line partially about a pulley at the end of the mooring pole, (e) attaching an end of the mooring line to the water craft and fastening an opposite end of the mooring line at least indirectly to the dock, (f) subsequently detaching the mooring line from the water craft and pivoting the mooring pole and the swivel member so that the mooring pole assumes a substantially vertical orientation, (g) sliding a locking member along the swivel member and inserting a locking tab on the locking member into an upper end of the support, to releasably lock the swivel member to the support with the mooring pole in the substantially vertical orientation, (h) subsequently sliding the locking member at least partially upwardly along the swivel member and removing the locking tab from the support, and (i) thereafter tilting the swivel member and the mooring pole away from the dock and over a water-traveling vessel located beside the dock. The pivoting and the tilting of the swivel member each includes shifting the swivel member laterally relative to a shaft connected to the support and concomitantly translating the swivel member relative to the support. The swivel member has two opposed walls each provided with an opening, with the shaft traversing the openings. The shaft is preferably cylindrical and has an outer diameter, while the openings in the swivel member are larger than the outer diameter of the shaft, thereby enabling play in the movement of the swivel member relative to the support.

The present invention provides a pole and pole holder system vertically mounted securely to a dock piling by means of replacing the four hole flat plate with a "C" channel which then can be mounted to the side of a dock piling. The alternative piling mounted embodiment also has a housing support for the pole which has the means to swivel or rotate from the normal operating position to a vertical position with the means of a locking feature providing boat clearance of the pole or whip when departing or returning to a dock.

DETAILED DESCRIPTION OF THE INVENTION

Figure 1:
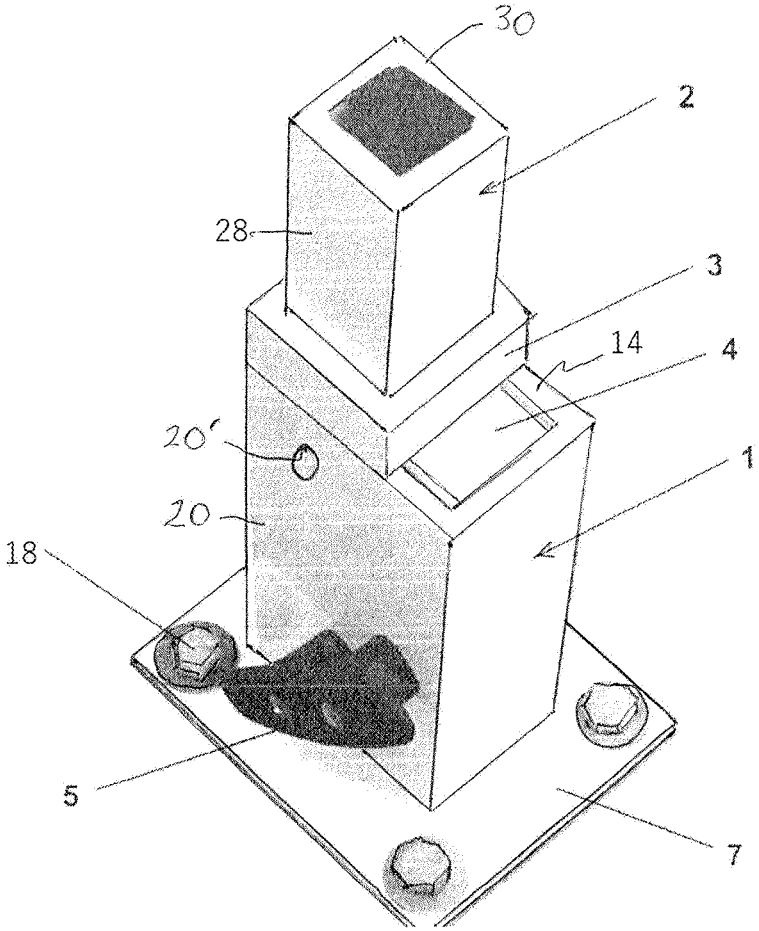
FIG. 1 is a perspective view of a preferred embodiment of a mooring whip base in accordance with the present invention, showing the base in a locked vertical position.

As illustrated in the drawings, a pole holder or mooring whip base 10 for holding a mooring pole 12 (FIG. 4) comprises a hollow support housing 1, a pole-supporting hollow swivel housing 2, a shaft 8, and a sliding drop lock 3 in the form of a polygonal frame surrounding and in slidingly engagement with the swivel housing 2. The mooring pole 12 is inserted into and rests in the swivel pole housing 2. When the mooring pole 12 and concomitantly the swivel pole housing 2 are rotated from an inclined working configuration (see FIGS. 1 and 4) to a vertical inactive or storage orientation (see FIG. 2), the rectangular drop lock 3 falls along the swivel housing 2 and seats on an upper edge or perimeter 14 of support housing 1. A locking plate or tab extension 4 rigid with the swivel housing 2 inserts into an upper end of support housing 1, and locks swivel housing 2 and necessarily mooring pole 12 to the support housing 1 and a dock 16 to which the support housing is fastened by bolts 18 traversing holes 6 in a mounting plate or flange 7 at a bottom end of support housing 1.

Figure 3:
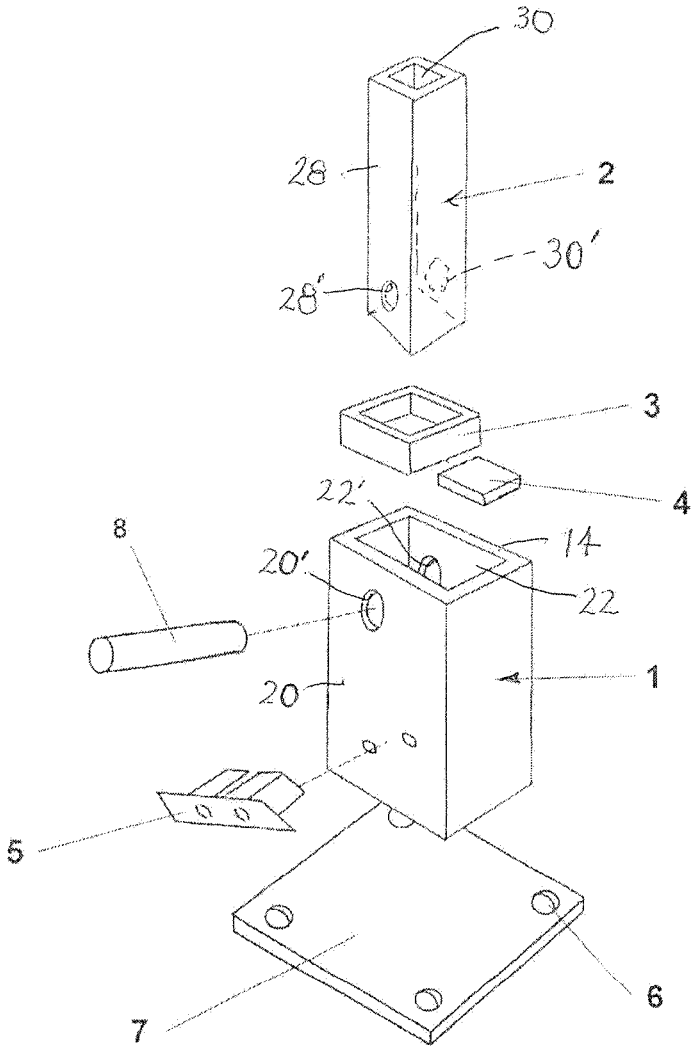
FIG. 3 is an exploded perspective view of the mooring whip base of FIGS. 1 and 2, showing components thereof.

The swivel housing 2 has a lower portion (not separately designated) movably disposed in the support housing 1, a lower end of the mooring pole 12 being removably inserted into the swivel housing. As shown in FIG. 3, the support housing 1 has two opposed walls 20 and 22 each provided with a respective opening 20' and 22'. The shaft 8 is at least translatably fixed to the support housing 1 in the openings 20' and 22'.

Figure 2:
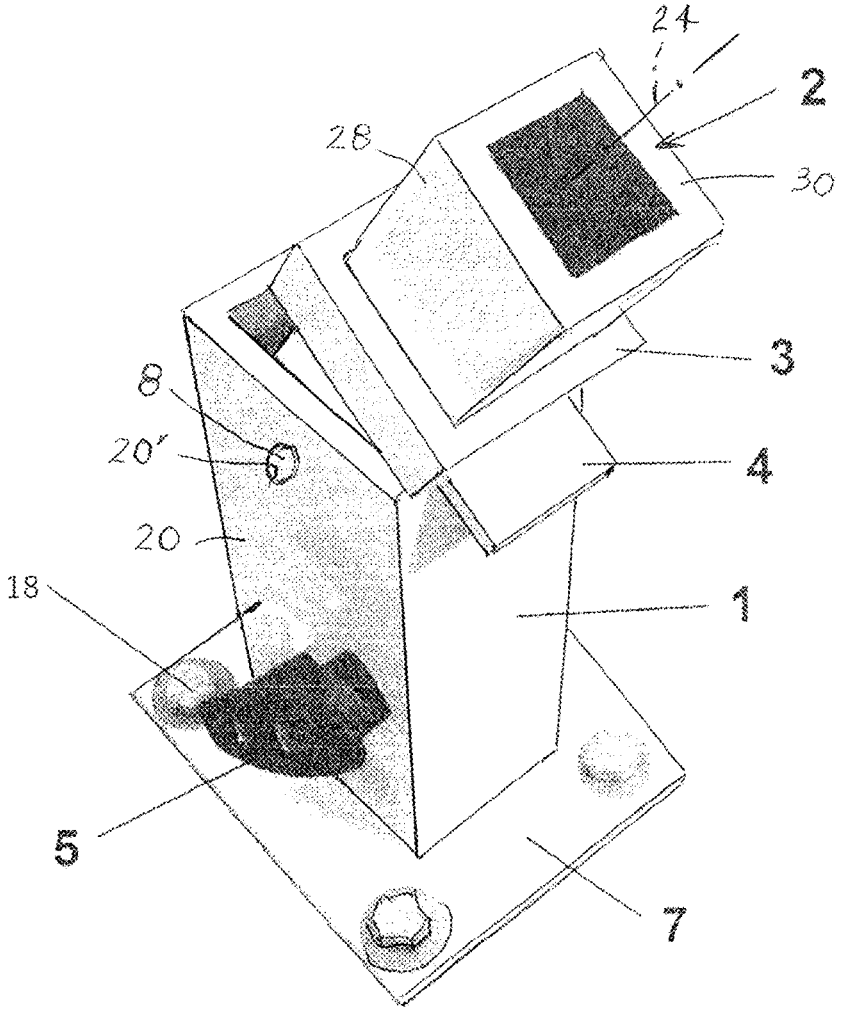
FIG. 2 is a perspective view of the mooring whip base of FIG. 1, showing the base in an angled or downwardly inclined working position.
Figure 4:
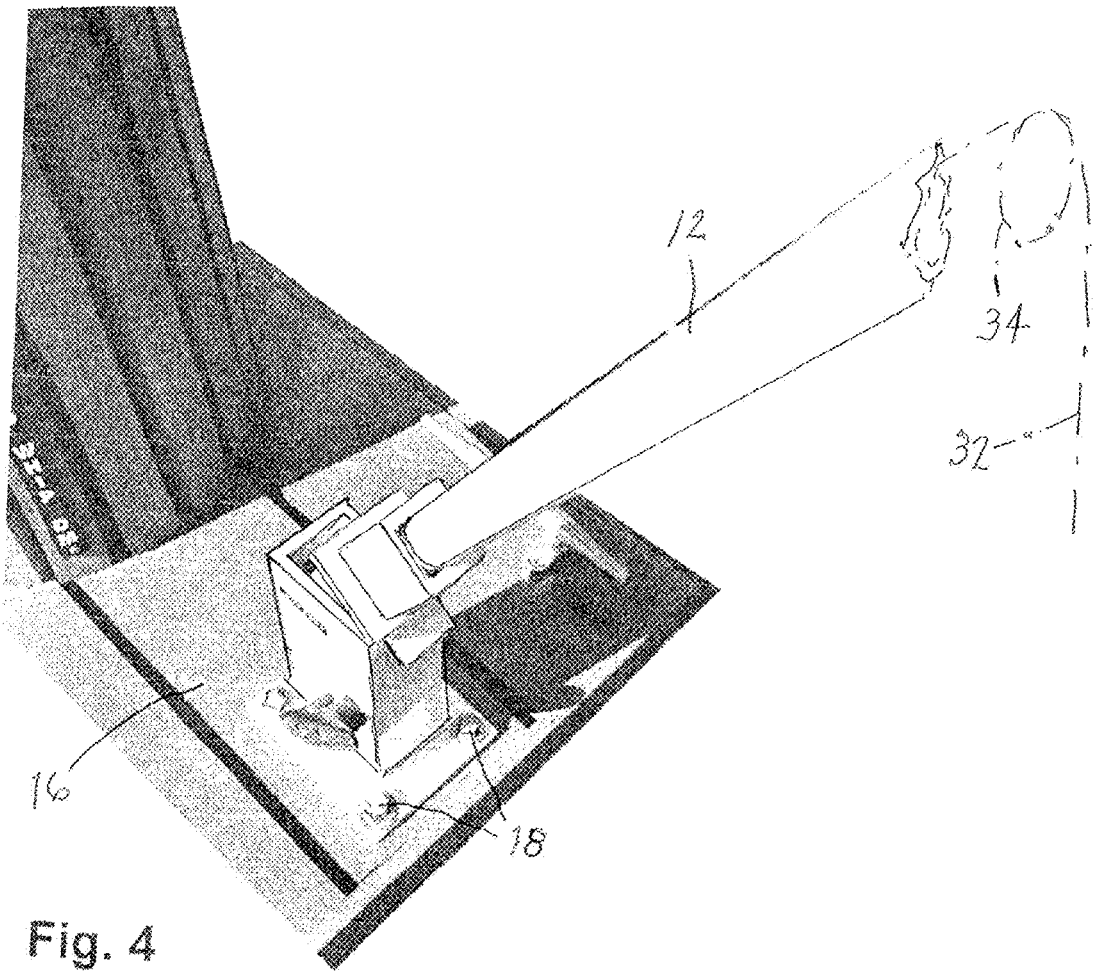
FIG. 4 is a perspective view of the mooring whip base of FIGS. 1-3, showing the base assembled with a mooring pole inserted.

The locking plate or tab 4 extends from the polygonal drop-lock frame 3 in a plane perpendicular to a longitudinal axis 24 (FIG. 2) of the swivel housing 2. The locking plate or tab 4 is insertable into the hollow support housing 1 at an upper end thereof for releasably preventing a pivoting of the swivel housing 2 upon a disposition thereof in a vertical or upright orientation relative to the support housing, as shown in FIGS. 1 and 4.

The support housing 1 and the swivel housing 2 each have the form of a right rectangular prismatic tubular member having a rectangular perimeter or wall. The sliding polygonal drop-lock frame 3 is concomitantly rectangular, with the locking plate or tab 4 being attached to a lower side of the drop-lock frame. The drop-lock frame 3 rests on the upper edge or perimeter 14 of the support housing 1 upon a disposition of the swivel housing 2 in the vertical or upright orientation (FIG. 2) relative to the support housing.

Plate or flange 7 constitutes a mounting member serving to attach the support housing 1 at least indirectly to the dock 16. The support housing 1, the hollow swivel housing 2, the polygonal drop-lock frame 3, and the locking plate or tab 4 are all preferably made of a hard and substantially rigid polymeric material. The various components which are attached to one another may be bonded my adhesive, heat welding, ultrasonic welding or any other appropriate technique.

The shaft 8 connecting the swivel housing 2 to the support housing 1 is preferably cylindrical and has an outer diameter. The swivel housing 2 has a pair of opposed walls 28 and 30 provided with respective openings 28' and 30' traversed by the shaft 8. Openings 28' and 30' are over-size, that is, larger than the outer diameter of the shaft 8, thereby providing for translational play in the movement of the swivel housing 2 relative to the support housing 1. Openings 28' and 30' may be circular with a larger diameter than that of the shaft 8, or may be elongate and extending in a direction towards the water and a 'moored boat.

Flange 7 is configured for attaching support housing 1 and accordingly the entire mooring whip base 10 to a horizontal surface, such as the upper surface (not separately designated) of the dock 16. One skilled in the art will realize that the support housing may be attached to other structures of a dock, such as a piling. In that case, flange 7 is omitted and a side wall 20 or 22 is affixed to the piling exemplarily via a C-channel (not shown).

A mooring whip base 10 as disclosed herein broadly comprises the support 1, the swivel member 2, the shaft 8, and the locking member 3. The support 1 is attachable to dock 16. The swivel member 2 is at least pivotably mounted to the support 1. The swivel member 2 may translate to a limited extent relative to the support 1 to enable the pivoting movement of the swivel housing with or without the mooring pole 12 inserted therein. The shaft 8 attaches the swivel member 2 to the support 1 and is configured with the swivel member 2 and the support 1 so that the swivel member 2 is pivotable relative to the support 1. The locking member 3 slidably connects to the swivel member 2 for movement along the swivel member. The locking member 3 automatically slides down the swivel member 2 when the latter is pivoted, together with the mooring pole 12, from an inclined working position (FIG. 4) to a vertical neutral or storage position. The locking member 3 includes the extension, tongue or tab 4 projecting in a plane perpendicular to the longitudinal axis 24 of the swivel member 2. The extension 4 is releasably couplable to the support 1 for temporarily preventing pivoting of the swivel member 2 upon a disposition thereof in a vertical or upright orientation relative to the support. It is to be noted that in the vertical storage configuration the swivel member 2 and the mooring pole 12 need not stand rigid but are held sufficiently vertical to not interfere with boat mooring and launching procedures.

Preferably, the support 1 and the swivel member 2 each take the form of a tubular member, with a lower end of the swivel member being inserted into the support. More preferably, the support 1 and the swivel member 2 each take the form of a right rectangular prismatic tubular member—that is, a box-like configuration.

The locking member 3 preferably surrounds the swivel member 2 and is slidable along the swivel member parallel to the axis 24 thereof, the extension or tongue or tab 4 being attached to a lower side of the locking member. The locking member 3 rests on the upper edge 14 of the support 1 and the extension 4 is located inside an upper end of the support upon a disposition of the swivel member 2 in the vertical or upright orientation relative to the support.

In mooring a boat or other water craft (not shown) to the dock 16, the user inserts a lower end of the mooring pole 12 into the swivel member 2 and pivots the swivel member 2 relative to the support 1 so that the mooring pole 12 extends at an acute angle from the dock 16 towards (and perhaps over) a watercraft. The user extends a mooring line or rope 32 (FIG. 4) partially about a pulley 34 at the end of the mooring pole 12, attaches an end of the mooring line 32 to the water craft, and fastens an opposite end of the mooring line 32 at least indirectly to the dock 16. Mooring whip line or rope 32 is attached at one end to a boat cleat 5 and passes over pulley 34 at the free or upper end of mooring pole 12. (As line 32 tightens and the pole 12 flexes as the boat glides away from the dock, restoring forces that increase in magnitude serve to return the boat towards the dock.) The user subsequently detaches the mooring line 32 from the water craft, for instance, when the water craft is to be placed into service, and pivots the mooring pole 12 and the swivel member 2 so that the mooring pole assumes a substantially vertical orientation. The locking member 3 slides along the swivel member 2 to rest on the upper edge 14 of the support housing 1 while the locking tab 4 inserts into an upper end of the support 1. The locking tab 4 releasably restrains the swivel member 2 relative to the support 1 to hold the mooring pole 12 in the substantially vertical orientation. Subsequently the user slides the locking member 3 at least partially upwardly along the swivel member 2 and removes the locking tab 4 from the support 1, thereafter tilting the swivel member 2 and the mooring pole 12 away from the dock and over a water-traveling vessel located beside the dock. The pivoting and the tilting of the swivel member 2 each includes shifting the swivel member laterally relative to the shaft 8 (connected to the support 1) and concomitantly translating the swivel member 2 relative to the support 1.

From the description above, a number of advantages of the preferred embodiment of the pole holder vertical mounting swivel support base become evident. Having the means and particular structure and soundness of to be vertically mounted and locked in position the vertical mounting swivel support base 1 can be more securely mounted to a portion of a dock structure that provides a more substantial means of support required for loads that occur from boats larger or small. The ability to mechanically swivel to a vertical position the base support containing the pole and its housing to a vertical position eliminating any possible collision with the poles and lines attached to the poles and any part of the boat while leaving or returning from docking a boat. The ability to manually swivel to a vertical position the pole support and the ability to maintain a positive vertical position by means of a locking device unquestionably secures the pole in a vertical position eliminating any possible collision with the whip poles and lines attached to the whip poles and any part of the boat while leaving or returning from the dock.

Although the invention has been described in terms of particular embodiments and applications, one of ordinary skill in the art, in light of this teaching, can generate additional embodiments and modifications without departing from the spirit of or exceeding the scope of the claimed invention.

While the above description contains much specificity, the specific features should not be construed as limitations on the scope of the invention, but rather as an exemplification of one preferred embodiment thereof. Many other variations are possible, for example:

A. Swivel pole holders as described herein may be securely mounted to dock pilings, fixed position pole holders mounted on pilings, and fixed position pole holders mounted on the deck of docks.

B. The widths, lengths, sizes and shapes of the components may vary but with no effectual change on the advantages provided by this invention.

C. This invention demonstrates how the poles may be rotated vertically, positioned manually. However the rotation and positioning can be accomplished by other means, for instance, with the use of counter weights and the introduction of tension springs. Thus the vertical swivel may be partially or completely automatic.

D. The whip pole 12 may also be extended over the dock and boat using a vertical mount but in a fixed angled position secured firmly to the vertical support.

Accordingly, it is to be understood that the drawings and descriptions herein are proffered by way of example to facilitate comprehension of the invention and should not be construed to limit the scope thereof.

What is claimed is:

1. A mooring whip base comprising:

a hollow support housing attachable to a dock;

a hollow swivel housing having a lower portion movably disposed in the support housing, a lower end of a mooring pole being insertable into the swivel housing, the hollow swivel housing having two opposed walls provided each provided with an opening;

a shaft fixed to the support housing and traversing the openings in the two opposed walls of the hollow swivel housing;

a polygonal frame surrounding the hollow swivel housing and slidably mounted thereto; and a locking plate extending from the polygonal frame in a plane perpendicular to a longitudinal axis of the hollow swivel housing, the locking plate being insertable into the hollow support housing at an upper end thereof for releasably preventing a pivoting of the hollow swivel housing upon a disposition thereof in a vertical or upright orientation relative to the support housing.

2. The mooring whip base defined in claim 1 wherein the hollow support housing and the hollow swivel housing are each a right rectangular prismatic tubular member having a rectangular perimeter.

3. The mooring whip base defined in claim 2 wherein the polygonal frame is rectangular, the locking plate being attached to a lower side of the polygonal frame, the polygonal frame resting on an upper edge of the hollow support housing upon a disposition of the hollow swivel housing in the vertical or upright orientation relative to the hollow support housing.

4. The mooring whip base defined in claim 1, further comprising a mounting member, the hollow support housing being fixed to the mounting member, the mounting member being connectable at least indirectly to the dock.

5. The mooring whip base defined in claim 1 wherein the hollow support housing, the hollow swivel housing, the polygonal frame, and the locking plate are all made of polymeric material.

6. The mooring whip base defined in claim 1 wherein the shaft is cylindrical with an outer diameter, the openings being larger than the outer diameter.

7. A mooring whip base comprising:

a support attachable to a dock;

a swivel member at least pivotably mounted to the support, a lower end of a mooring pole being releasably couplable to the swivel member;

a shaft attaching the swivel member to the support and configured with the swivel member and the support so that the swivel member is pivotable relative to the support; and a locking member slidably connected to the swivel member for movement along the swivel member, the locking member including an extension projecting in a plane perpendicular to a longitudinal axis of the swivel member, the extension being releasably couplable with the support for temporarily preventing pivoting of the swivel member upon a disposition thereof in a vertical or upright orientation relative to the support.

8. The mooring whip base defined in claim 7 wherein the support and the swivel member each take the form of a tubular member, a lower end of the swivel member being inserted into the support.

9. The mooring whip base defined in claim 7 wherein the shaft defines a pivot axis of the swivel member, the shaft being fixed to the support.

10. The mooring whip base defined in claim 9 wherein the shaft traverses a pair of openings in the swivel member, the shaft being cylindrical with an outer diameter, the openings being larger than the outer diameter.

11. The mooring whip base defined in claim 8 wherein said locking member surrounds the swivel member and is slidable along the swivel member parallel to an axis thereof, the extension being attached to a lower side of the locking member, the locking member resting on an upper edge of the support and the extension being located inside an upper end of the support upon a disposition of the swivel member in the vertical or upright orientation relative to the support.

12. The mooring whip base defined in claim 7, further comprising a mounting member, the support being fixed to the mounting member, the mounting member being connectable at least indirectly to the dock.

13. The mooring whip base defined in claim 7 wherein the support, the swivel member, the locking member, and the extension are all made of polymeric material.

14. A mooring whip base comprising:

a hollow right rectangular prismatic support housing attachable to a dock;

a hollow right rectangular prismatic swivel housing having a lower portion disposed in the support housing for pivoting relative thereto, a lower end of a mooring pole being insertable into the hollow right rectangular prismatic swivel housing, the hollow right rectangular prismatic swivel housing having two opposed walls provided each provided with an opening;

a shaft fixed to the hollow right rectangular prismatic support housing and traversing the openings in the two opposed walls of the hollow right rectangular prismatic swivel housing;

a rectangular frame surrounding the hollow right rectangular prismatic swivel housing and slidably mounted thereto; and a locking plate extending from the rectangular frame in a plane perpendicular to a longitudinal axis of the hollow right rectangular prismatic swivel housing, the locking plate being insertable into the hollow right rectangular prismatic support housing at an upper end thereof for releasably preventing pivoting of the hollow right rectangular prismatic swivel housing relative to the hollow right rectangular prismatic support housing upon a disposition of the hollow right rectangular prismatic swivel housing in a vertical or upright orientation relative to the hollow right rectangular prismatic support housing.

15. The mooring whip base defined in claim 14 wherein the rectangular frame rests on an upper edge of the hollow right rectangular prismatic support housing upon a disposition of the hollow right rectangular prismatic swivel housing in the vertical or upright orientation relative to the hollow right rectangular prismatic support housing.

16. The mooring whip base defined in claim 14, further comprising a mounting member, the hollow right rectangular prismatic support housing being fixed to the mounting member, the mounting member being connectable at least indirectly to the dock.

17. The mooring whip base defined in claim 14 wherein the hollow right rectangular prismatic support housing, the hollow right rectangular prismatic swivel housing, the rectangular frame, and the locking plate are all made of polymeric material.

18. The mooring whip base defined in claim 14 wherein the shaft is cylindrical with an outer diameter, the openings being larger than the outer diameter.

19. A mooring method comprising:

providing a whip base including a support attached to a dock;

inserting a lower end of a mooring pole into a swivel member pivotably attached to the support;

pivoting the swivel member relative to the support so that the mooring pole extends at an acute angle from the dock towards a watercraft;

extending a mooring line partially about a pulley at the end of the mooring pole;

attaching an end of the mooring line to the water craft and fastening an opposite end of the mooring line at least indirectly to the dock;

subsequently detaching the mooring line from the water craft and pivoting the mooring pole and the swivel member so that the mooring pole assumes a substantially vertical orientation;

sliding a locking member along the swivel member and inserting a locking tab on the locking member into an upper end of the support, to releasably lock the swivel member to the support with the mooring pole in the substantially vertical orientation;

subsequently sliding the locking member at least partially upwardly along the swivel member and removing the locking tab from the support; and thereafter tilting the swivel member and the mooring pole away from the dock and over a water-traveling vessel located beside the dock.

20. The method defined in claim 19 wherein the pivoting and the tilting of said swivel member each include shifting the swivel member laterally relative to a shaft connected to the support and concomitantly translating the swivel member relative to the support, the swivel member having two opposed walls provided each provided with an opening, the shaft traversing the openings, the shaft being cylindrical with an outer diameter, the openings being larger than the outer diameter thereby enabling play in movement of the swivel member relative to the support.

* * * * *